United States Patent [19]

Mitchell

[11] 4,145,099

[45] Mar. 20, 1979

[54] RETRACTABLE PULPIT OR THE LIKE

[76] Inventor: George E. Mitchell, 210 Admiral Dr., London, Canada

[21] Appl. No.: 865,535

[22] Filed: Dec. 29, 1977

[51] Int. Cl.[2] ..... A47G 33/00

[52] U.S. Cl. ..... 312/33; 312/22; 52/27; 297/187

[58] Field of Search ..... 312/33, 312, 22; 52/32, 52/27-29, 36; 297/15, 187

[56] References Cited

U.S. PATENT DOCUMENTS

| | | | |
|---|---|---|---|
| 1,801,681 | 4/1931 | Mowery | 297/15 |

FOREIGN PATENT DOCUMENTS

| | | | |
|---|---|---|---|
| 968024 | 11/1950 | France | 312/33 |
| 72415 | 6/1946 | Norway | 312/241 |
| 272535 | 12/1950 | Switzerland | 297/15 X |
| 15780 of | 1912 | United Kingdom | 297/15 X |

*Primary Examiner*—Victor N. Sakran

*Attorney, Agent, or Firm*—Howard I. Podell

[57] ABSTRACT

A pulpit, altar or other platform may be retracted into an opening in the floor of a building such as a church. In one form of the invention, the pulpit assembly is connected to means for moving it vertically into and out of the opening. In another form, the pulpit is foldable and can be stored in the opening after folding the retable of the pulpit assembly and contains two flanking side tables swingably hinged thereto.

2 Claims, 6 Drawing Figures

RETRACTABLE PULPIT OR THE LIKE

FIELD OF THE INVENTION

This invention relates generally to folding or collapsible platforms such as altars or pulpits.

DESCRIPTION OF THE PRIOR ART

The prior art, as exemplified by U.S. Pat. Nos. 2,547,966; 1,616,198; 3,120,410 is generally illustrative of various devices of this type. While such devices are generally acceptable for their intended purpose they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need and the efforts of many individuals and companies to develop such devices, a satisfactory device meeting this need has heretofore been unavailable.

The principal object of the invention is to provide a device or article of this character which combines simplicity, strength and durability in a high degree, together with inexpensiveness of construction so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a pulpit, altar or other platform may be retracted into an opening in the floor of a building such as a church. In one form of the invention, the pulpit assembly is connected to means for moving it vertically into and out of the opening.

In another form, the pulpit is foldable and can be stored in the opening after folding the retable of the pulpit assembly and contains two flanking side tables swingably hinged thereto.

BRIEF DESCRIPTION OF THE DRAWING

In the accompanying drawing, in which are shown two of the various possible illustrative embodiments of this invention, wherein like reference character identify the same or like parts.

DESCRIPTION OF THE PREFERRED EMBODIMENT

Figure 4:
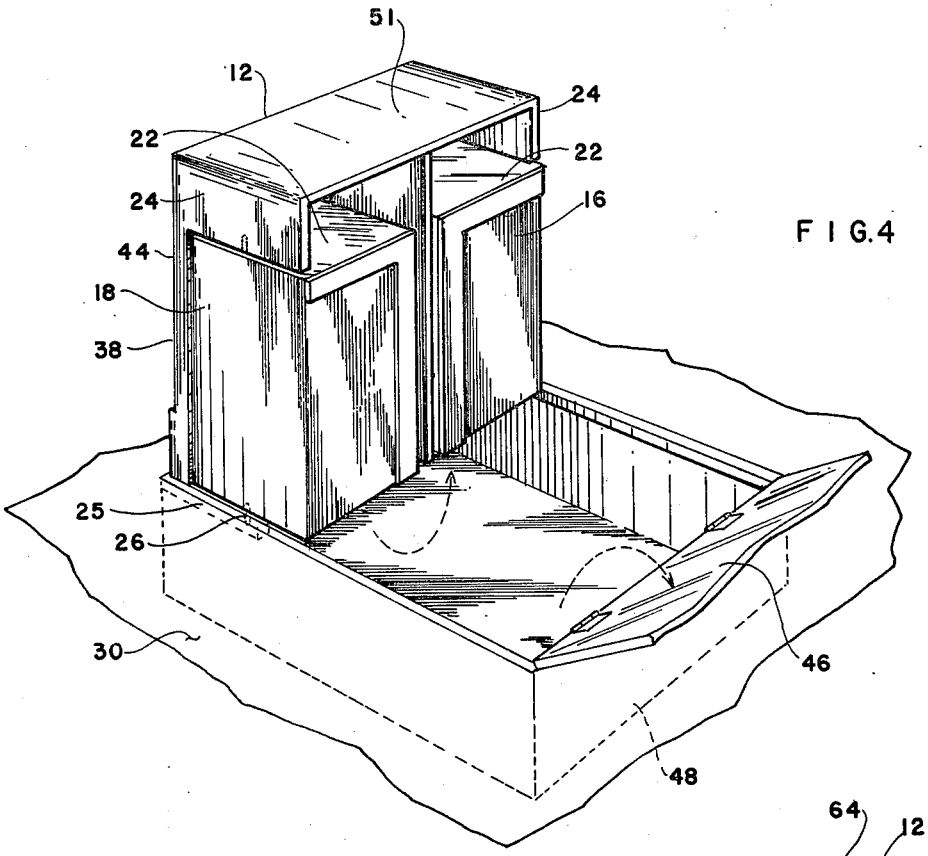
FIGS. 4 and 5 are perspective views of the same of the invention shown.
Figure 5:
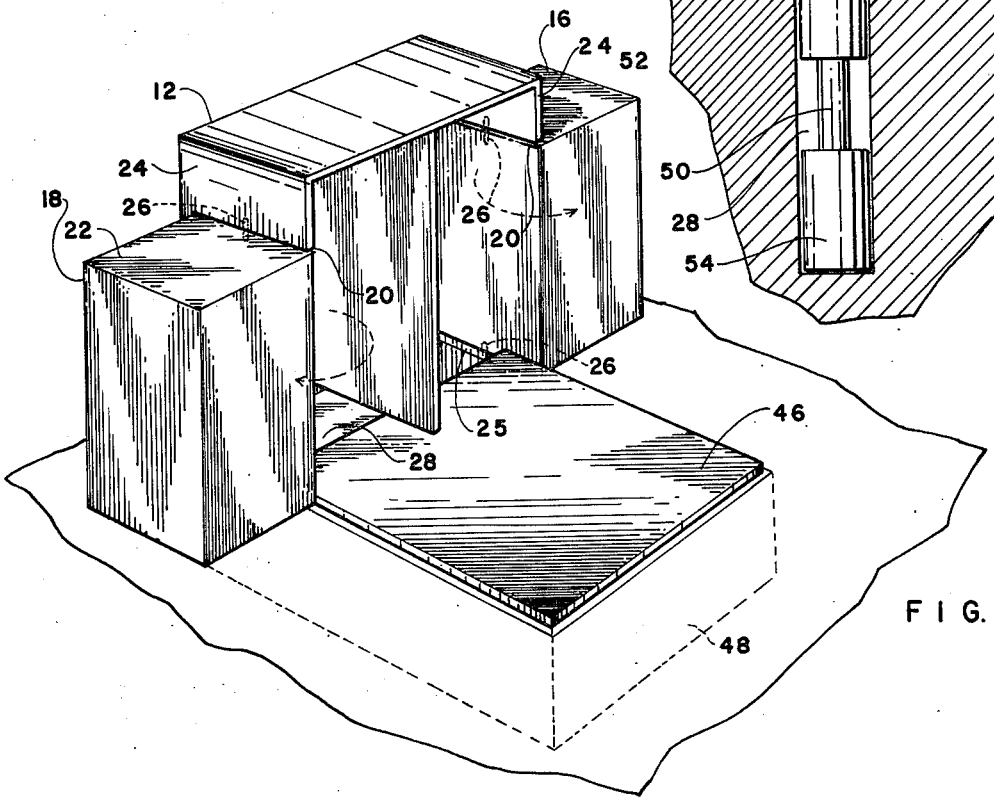

With reference to the drawing, there is shown and illustrated a foldable platform constructed in accordance with the principles of the invention and designated generally by reference character 10. The illustrated tangible embodiment of the invention includes a retable 12 for supporting a book 14. Retable 12, as shown in FIGS. 4 and 5 is flanked by side tables 16 and 18 which are hingedly secured thereto from the inner wall 20 of their top 22 to the depending side walls 24 of retable 12 and to its bottom arms 25 and hinges 26. As shown in FIG. 5, side tables 16 and 18 swing out from retable 12 as indicated by the arrows to use position.

Figure 1:
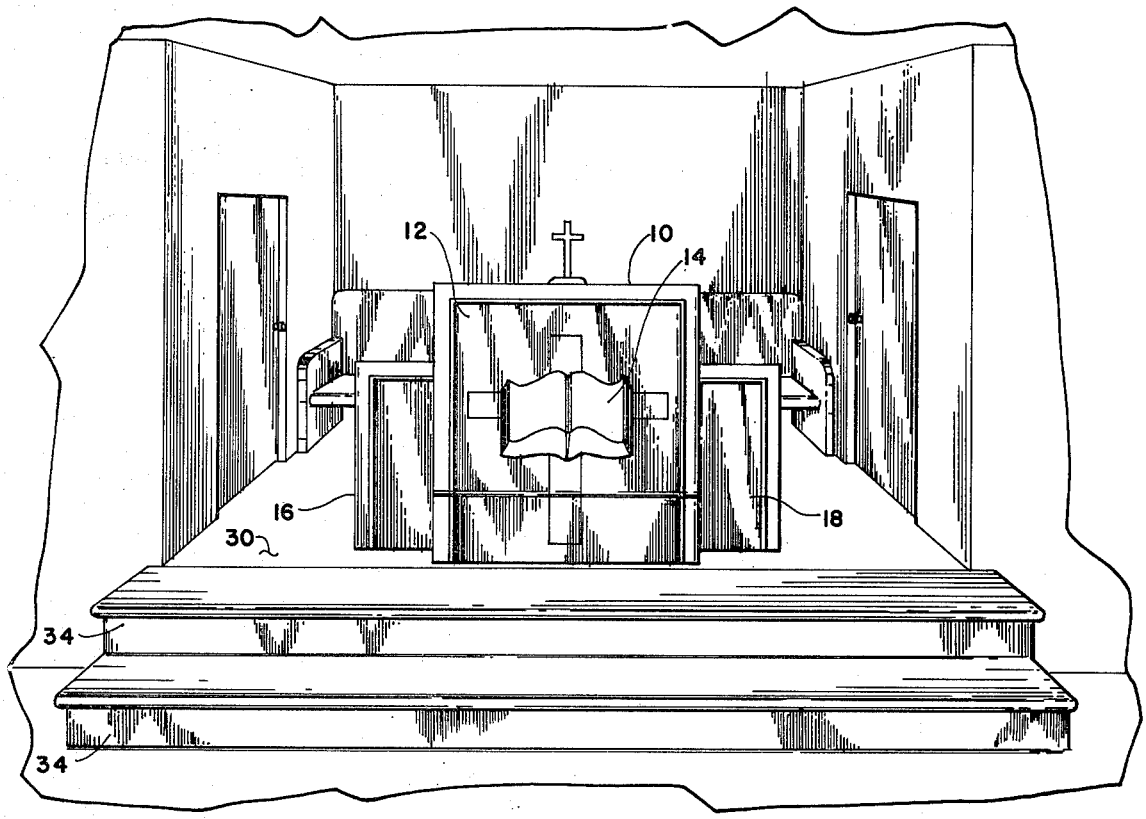
FIG. 1 is a perspective view of an unfolded altar acccrding to the invention.
Figure 2:
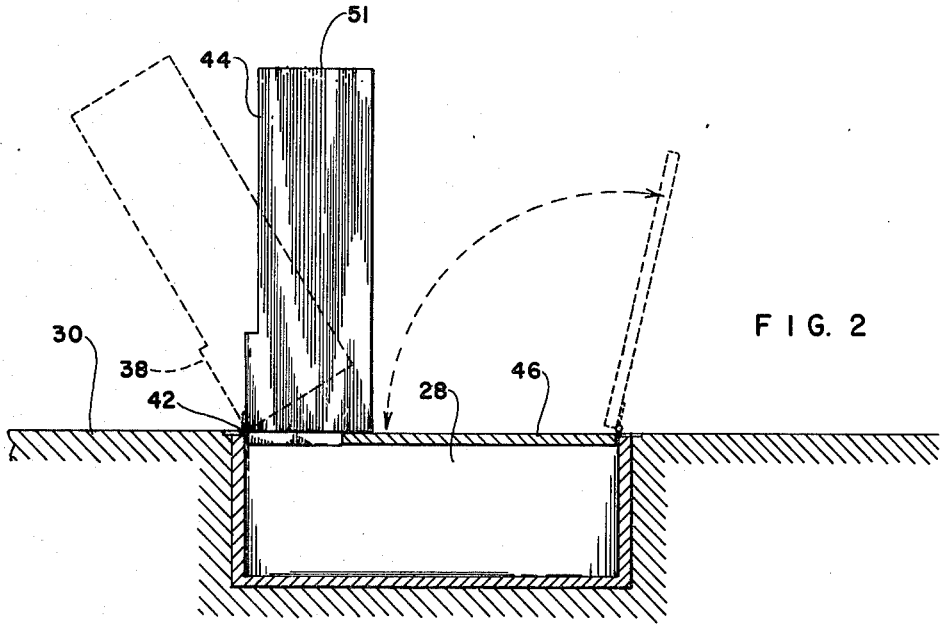
FIG. 2 is cross-sectional view of a foldable pulpit in accord with the invention.
Figure 3:
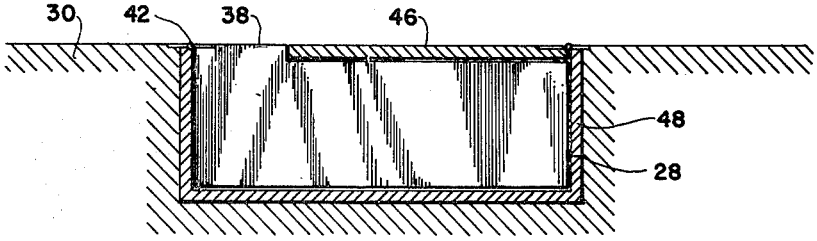
FIG. 3 is the same as FIG. 2 but shows same folded.

As shown in FIGS. 2 and 3 this version of the invention is associated with a central, substantially rectangular opening 28 in the main floor 30 of a building such as a church, temple or the like. This main floor 30 provides the support for the audience seating accomodation including a bench 32 for the celebrants, and may include steps 34 leading toward the front or back of the edifice.

It will be appreciated that the assembly above described folds down into opening 28 which is lined with panels to give it a box-like configuration. The front panel 38 of retable 12 is hinged to the front panel 40 in opening 28 by hinge 42 so as to allow the assembly to fold down therein as shown in FIG. 3 after it has been folded on itself to the configuration shown on FIG. 4.

As shown most clearly in FIG. 2, the upper surface 44 of front 38 is recessed to receive thereon top folding panel 46 hinged to back panel 48 by hinges 26 to form a folded arrangement which is flush with main floor 30 as shown in FIG. 3.

Figure 6:
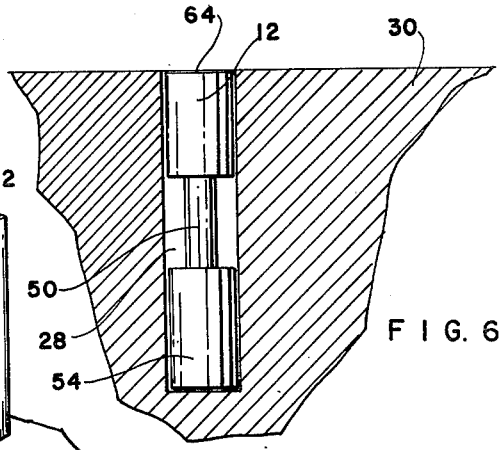
FIG. 6 is a schematic view of another version of the invention.

FIG. 6 shows another version of the invention wherein the foldable assembly previously described as consisting of the retable 12 flanked by the side tables 16 and 18 foldably secured thereto is provided with elevating and lowering means designated generally by reference character 50 and shown somewhat diagrammatically. This means includes a vertically disposed ram suitably connected at one end to the underside 52 of the assembly while its other end is disposed in a well 54 formed below the level of the floor 64 of opening 28. Suitable conduits are provided for conducting hydraulic fluid under pressure from a hydraulic pump (not shown) to the ram 50 to elevate the assembly; conventional control means (not shown) are also provided for supplying well 54 with fluid under pressure to elevate the assembly and for permitting the fluid to exhaust to a sump to lower the assembly so that its upper surface 64 is flush with floor 28. The control means can include a push button located at any desired place such as the top of retable 12.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use. Its advantages are easily seen.

It is thought that persons skilled in the art to which this invention relates will be able to obtain a clear understanding of the invention after considering the foregoing description in connection with the accompanying drawing. Therefore, a more lengthy description is deemed unnecessary.

It is to be understood that various changes in shape, size and arrangement of the elements of this invention as claimed may be resorted to in actual practice, if desired.

Having thus described the invention what is claimed as new and to be secured by Letters Patent is:

1. A retractable pulpit or the like adapted to retract into an opening in the floor of an edifice comprising a central retable having a front vertical panel, depending side walls and horizontal brackets extending from its lower section; side tables swingably hinged to said retable and foldable therein; said front panel being foldably connected to said opening so that said opening receives said retable when containing said side tables, with a portion of the surface of said front panel serving as floor surface in covering said opening in the retracted mode of the pulpit, further including a recess on the outer surface of said front panel and a top panel foldably secured to said opening, said top panel fitting in said recess of said front panel when said retable is in said opening, such that the surface of said top panel serves as floor surface in covering said opening in the retracted mode of the pulpit.

2. The invention as recited in claim 1, further including hydraulic means for moving said retable between a raised position, and a lowered position wherein the top surface thereof is substantially at the level of said floor.

* * * * *